US007116248B2

(12) United States Patent
Lu et al.

(10) Patent No.: US 7,116,248 B2
(45) Date of Patent: Oct. 3, 2006

(54) VEHICLE DETECTOR SYSTEM WITH SYNCHRONIZED OPERATION

(75) Inventors: Jason Zhen-Yu Lu, Sparks, NV (US); Benjamin Luke, Sparks, NV (US); Allen Jacobs, Reno, NV (US)

(73) Assignee: Reno A & E, Reno, NV (US)

( * ) Notice: Subject to any disclaimer, the term of this patent is extended or adjusted under 35 U.S.C. 154(b) by 0 days.

(21) Appl. No.: 10/719,322

(22) Filed: Nov. 20, 2003

(65) Prior Publication Data

US 2005/0110659 A1 May 26, 2005

(51) Int. Cl.
*G08G 1/01* (2006.01)

(52) U.S. Cl. ..... 340/933; 340/917; 340/919; 340/941; 324/207.15; 324/243

(58) Field of Classification Search ..... 340/933, 340/941, 934, 906, 917, 919; 324/207.15, 324/228, 243; 701/117
See application file for complete search history.

(56) References Cited

U.S. PATENT DOCUMENTS

| | | | | |
|---|---|---|---|---|
| 4,239,415 | A * | 12/1980 | Blikken | 404/75 |
| 6,337,640 | B1 * | 1/2002 | Lees | 340/933 |
| 6,345,228 | B1 * | 2/2002 | Lees | 701/117 |
| 6,417,784 | B1 * | 7/2002 | Hilliard et al. | 340/941 |
| 6,611,210 | B1 * | 8/2003 | Hilliard et al. | 340/941 |
| 6,639,521 | B1 * | 10/2003 | Hilliard et al. | 340/941 |
| 6,864,804 | B1 * | 3/2005 | Allen et al. | 340/933 |

* cited by examiner

*Primary Examiner*—Davetta W. Goins

(57) ABSTRACT

A vehicle detector system having a number of individual vehicle detectors each capable of sampling a plurality of vehicle loops in mutual synchronization. One detector operates as a master detector for synchronization purposes; the other detectors are operated as slave detectors. The system can be configured for series or parallel synchronous operation. The system is particularly advantageous in installations requiring a large number of closely spaced vehicle loops each operated by a detector set to high sensitivity.

7 Claims, 4 Drawing Sheets

VEHICLE DETECTOR SYSTEM WITH SYNCHRONIZED OPERATION

BACKGROUND OF THE INVENTION

This invention relates to vehicle detectors used to detect the presence or absence of a motor vehicle in an inductive loop embedded in a roadbed. More particularly, this invention relates to a vehicle detector system with synchronized operation of several vehicle detectors.

Vehicle detectors have been used for a substantial period of time to generate information specifying the presence or absence of a vehicle at a particular location. Such detectors have been used at intersections, for example, to supply information used to control the operation of the traffic signal heads; have been used in railway installations for railway car detection and control; and have also been used to supply control information used in conjunction with automatic entrance and exit gates in parking lots, garages and buildings.

A widely used type of vehicle detector employs the principle of period shift measurement in order to determine the presence or absence of a vehicle in or adjacent the inductive loop mounted on or in a roadbed. In such systems, a first oscillator, which typically operates in the range from about 10 to about 120 kHz is used to produce a periodic signal in a vehicle detector loop. A second oscillator operating at a much higher frequency is commonly used to generate a sample count signal over a selectable, fixed number of loop cycles. The relatively high frequency count signal is typically used to increment a counter, which stores a number corresponding to the sample count at the end of the fixed number of loop cycles. This sample count is compared with a reference count stored in another counter and representative of a previous count in order to determine whether a vehicle has entered or departed the region of the loop in the time period between the previous sample count and the present sample count.

The initial reference value is obtained from one or more initial sample counts and stored in a reference counter. Thereafter, successive sample counts are obtained on a periodic basis, and compared with the reference count. If the two values are essentially equal, the condition of the loop remains unchanged, i.e., a vehicle has not entered or departed the loop. However, if the two numbers differ by at least a threshold amount in a first direction (termed the Call direction), the condition of the loop has changed and may signify that a vehicle has entered the loop. More specifically, in a system in which the sample count has decreased and the sample count has a numerical value less than the reference count by at least a threshold magnitude, this change signifies that the period of the loop signal has decreased (since fewer counts were accumulated during the fixed number of loop cycles), which in turn indicates that the frequency of the loop signal has increased, usually due to the presence of a vehicle in or near the loop. When these conditions exist, the vehicle detector generates a signal termed a Call Signal indicating the presence of a vehicle in the loop.

Correspondingly, if the difference between a sample count and the reference count is greater than a second threshold amount, this condition indicates that a vehicle which was formerly located in or near the loop has left the vicinity. When this condition occurs, a previously generated Call Signal is dropped.

The Call signals generated by a vehicle detector are used in a number of ways. Firstly, the Call signals are presented to an output terminal of the vehicle detector and forwarded to various types of traffic signal supervisory equipment for use in a variety of ways, depending on the system application. In addition, the Call signals are used locally to drive a visual indicator, typically a discrete light emitting diode (LED) or a multiple LED display or a liquid crystal display (LCD) to indicate the Call status of the vehicle detector, i.e. whether or not the vehicle detector is currently generating a Call signal.

Vehicle detectors with the Call signal generating capability described above are used in a wide variety of applications, including vehicle counting along a roadway or through a parking entrance or exit, vehicle speed between preselected points along a roadway, vehicle presence at an intersection controlled by a traffic control light system, or in a parking stall, in railroad yards, and numerous other applications.

In the past, vehicle detectors have been designed as either single channel or multiple channel detectors. A single channel detector is designed and configured to operate with only a single loop zone; while a multiple channel vehicle detector is designed and configured to operate with two or more independent loop zones. Multiple channel detectors are designed to be either scanning or non-scanning detectors. A scanning detector operates by sampling only one loop channel at a time, shutting down the active loop, sampling the next loop channel, shutting down that loop, etc. Scanning detectors have been typically used in installations in which the probability of cross-talk between loop circuits is more than minimal. Cross talk results when physically adjacent loops are operating at, or near, the same frequency. Cross talk is minimized or eliminated by operating physically adjacent loops on different frequencies. Non-scanning vehicle detectors are configured and function to monitor each of the multiple loop zones simultaneously. Non-scanning detectors are typically used in installations in which there is a very low or no possibility of cross-talk between the multiple loop circuits, such as installations at which the loops are physically separated by a distance sufficient to ensure no overlapping or intercoupling between the electrical fields associated with the loops.

While scanning and non-scanning vehicle detectors have been found to be useful in many installations involving multiple loops, there are many applications in which neither type can be configured to function properly. Such applications typically require many closely spaced loops to cover the region to be monitored for vehicle occupancy, and high detector sensitivity to detect a wide range of vehicle types, from motorcycles to large trucks. This exacerbates the problem of cross-talk among the loops. An example of such an application is a railroad crossing with many closely spaced loops.

SUMMARY OF THE INVENTION

The invention comprises a vehicle detector system with synchronized operation among several detectors which avoids the cross talk problem while still providing the requisite high sensitivity. Both serial and parallel configurations are provided.

From an apparatus standpoint the invention comprises a vehicle detector system having a plurality of individual vehicle detectors each capable of sampling one or more vehicle loops. One of the vehicle detectors is assigned the role of system master, and generates synchronization signals used to control the initialization of loop sampling of the remaining vehicle detectors in the system. The system can be configured in either a series mode or a parallel mode.

In series mode configuration, the synch output signal from the detector assigned the role as master is coupled to the synch input of the first slave detector in the series. When the first slave detector receives this signal, it starts the sampling of all loops which it is capable of sampling. After this detector has finished sampling its last channel, it sends a synch out signal to the next detector in the series, which commences sampling of its channels. After the last detector in the series has finished sampling all its channels, it sends a synch pulse to the master, signifying that all slave detectors in the series have finished their channel sampling. In response, the master begins sampling its channels, and the sequence repeats.

In parallel mode configuration, the synch output signal from the detector assigned the role as master is coupled to the synch input of all the slave detectors signalling them to start the sampling operation for channel 1 of each detector. After the last of the slave detectors has finished sampling channel 1, this event is recognized by the master detector by sensing the state of the signal on its synch signal input terminal, which is coupled to the synch output terminals of all the slave detectors. When the master detector receives this signal indicating that all detectors have finished sampling their channel 1 loop, the master detector sends a synch pulse to all the slave detectors signalling them to begin channel 2 sampling. When the last channel has been sampled, the operation is repeated.

Vehicle detector systems incorporating the invention enable the automatic synchronized operation of a large number of closely spaced loops with a plurality of vehicle detectors at high sensitivity For a fuller understanding of the nature and advantages of the invention, reference should be had to the ensuing detailed description taken in conjunction with the accompanying drawings.

DETAILED DESCRIPTION OF THE PREFERRED EMBODIMENTS

Figure 1:
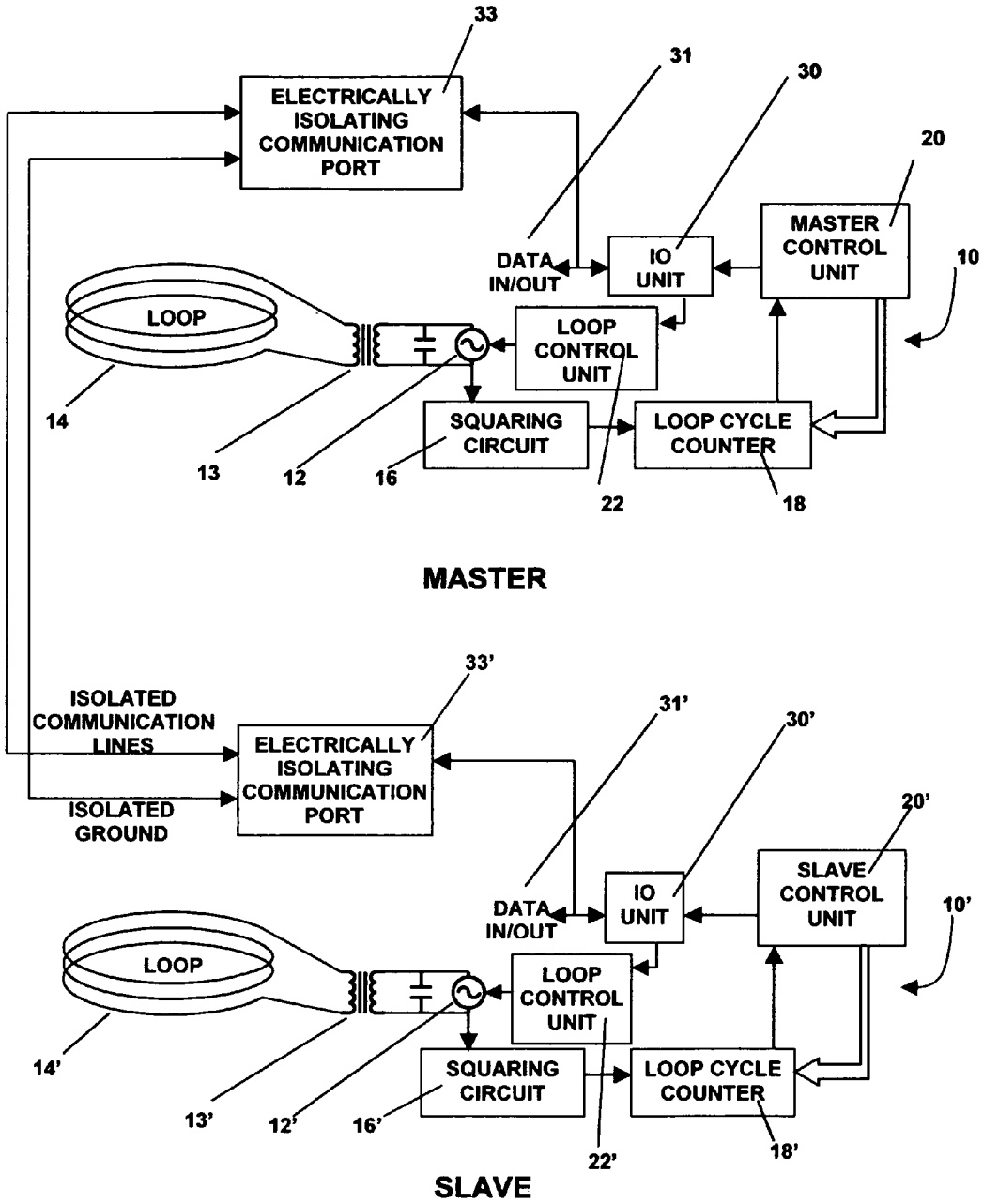
FIG. 1 is a block diagram of a vehicle detector incorporating the invention.

Turning now to the drawings, FIG. 1 is a block diagram of a vehicle detector system incorporating the invention. As seen in this Fig., the vehicle detector system includes a pair of vehicle detectors with synchronous intercoupling. A first vehicle detector 10 designated with the legend "MASTER" having an oscillator 12 operable over a frequency range of about 10 to about 120 kHz is coupled via a transformer 13 to an inductive loop 14. Inductive loop 14 is typically mounted within the roadbed in a position such that vehicles to be sensed will pass over the loop. Such loops are well-known and are normally found installed at controlled locations in the highway system, such as at intersections having signal heads controlled by a local intersection unit, parking lots with controlled access, railroad crossings, security barrier installations and the like. Loop 14 may also be mounted adjacent a track switch in a railway system.

The oscillator circuit 12 is coupled via a squaring circuit 16 to a loop cycle counter 18. Loop cycle counter 18 typically comprises a multi-stage binary counter having a control input for receiving appropriate control signals from a master control unit 20 and a status output terminal for providing appropriate status signals to the master control unit 20, in the manner described below.

Control unit 20 includes a second oscillator circuit which typically generates a precise, crystal controlled, relatively high frequency clock signal (e.g., a 6 mHz clock signal). This high frequency clock signal is coupled via a second squaring circuit to a second binary counter, both of which are also included in control unit 20. The second binary counter is typically a multi-stage counter having a control input for receiving control signals generated within control unit 20 and a count state output for generating signals representative of the count state of the second binary counter at any given time. The count state of the second binary counter is coupled as one input to an arithmetic logic unit included within control unit 20. The other input to the arithmetic logic unit is one or more reference values stored in a reference memory within control unit 20. The reference memory is controlled by appropriate signals generated within control unit 20 in the manner described below.

An input/output unit 30 is coupled between the control unit 20 and a loop control unit 22, and externally associated circuitry via control signal path 31. I/O unit 30 accepts appropriate control signals via signal path 31 to specify the control parameters for the vehicle detector unit of FIG. 1 such as mode, sensitivity, and any special features desired. I/O unit 30 furnishes data output signals via signal path 31, the data output signals typically comprising Call signals indicating the arrival or departure of a vehicle from the vicinity of the associated loop and other display signals. Loop control unit 22 controls the direct operation of oscillator 12.

Initially, control unit 20 supplies control signals to loop cycle counter 18 which define the length of a sample period for the high frequency counting circuit comprising the elements noted above. For example, if control unit 20 specifies a sample period of six loop cycles, loop cycle counter 18 is set to a value of six and, when the sample period is to commence, control unit 20 permits loop cycle counter 18 to begin counting down from the value of six in response to the leading edge of each loop cycle signal furnished via squaring circuit 16 from loop oscillator circuit 12. Contemporaneously with the beginning of the countdown of the loop cycle counter 18, control unit 20 enables the internal high frequency counter to accumulate counts in response to the high frequency signals received from the internal high frequency oscillator circuit via the second squaring circuit. At the end of the sample period (i.e., when the loop cycle counter has been counted down to zero), control unit 20 generates a disable signal for the high frequency counter to freeze the value accumulated therein during the sample period. Thereafter, this sample count value is transferred to the internal ALU and compared with the value stored in the reference memory, all under control of control unit 20. After the comparison has been made, the sample process is repeated.

The reference value in the reference memory is a value representative of the inductance of the loop oscillator circuit comprising elements 12–16 at some point in time. The reference is updated at the end of certain periods in response to certain comparisons involving the reference stored in the reference memory and successively obtained samples from the internal counter. Whenever the difference between a given sample from the internal counter and the reference from the reference memory exceeds a first threshold value in the Call direction, the control unit 20 senses this condition and causes the generation of an output signal—termed a Call signal—on signal path 31 indicating the arrival of a vehicle within the loop vicinity. Similarly, when the difference between a given sample and the previous reference exceeds a second threshold in the No Call direction the control unit 20 senses this condition and causes the Call output signal on signal path 31 to be dropped. In the preferred embodiment, the Call direction is negative and the Call direction threshold value is −8 counts; while the No Call threshold value is −5 counts.

Call signal path 31 is coupled to a user interface (not shown) having a display and operator switches which can be manipulated by the user to specify various functions and vehicle detector parameters, such as sensitivity, and designate a vehicle detector as a master detector for controlling the synchronization of the system.

A second vehicle detector 10, designated with the legend "SLAVE" is comprised of the same functional elements as MASTER detector 10. The functional elements of SLAVE detector 10' are designated with the same numerals using a prime symbol'. SLAVE detector 10' functions in the same manner as MASTER detector 10 for vehicle detection purposes, with the exception that MASTER detector 10 controls the synchronization of the system in the manner described below.

Power is supplied to the system elements depicted in FIG. 1 from a dedicated power supply (not shown) via appropriate power conductors. The power supply typically provides DC voltage to the electronic circuit components comprising the vehicle detector, and is usually powered by either AC or DC electrical power available at the installation site of the vehicle detector.

Each detector 10, 10' is provided with an electrically isolating communication port 33, 33' which enables communication of synchronization information between the MASTER and the SLAVE detectors. In general, communication ports 33, 33' enable the MASTER detector 10 to send sync out pulses generated by the master control unit 20 to the SLAVE detector 10', and enable the SLAVE detector 10' to send sync out pulses generated by the slave control unit 20' to the MASTER detector 10.

It is noted that, although only one loop 14, 14' has been illustrated for MASTER detector 10 and SLAVE detector 10', in practice each detector in th system can be a scanning detector with several channels each for op rating an associated loop. A four channel detector is typical. In addition, although only a single MASTER detector 10 and SLAVE detector 10' are illustrated in FIG. 1, in practice there will typically be a larger number of SLAVE detectors in th system in synchronous communication with a single MASTER detector 10: either directly (in a parallel synchronization configuration) or indirectly (in a series synchronization configuration). The examples described below assume three SLAVE detectors and one MASTER detector.

Figure 2:
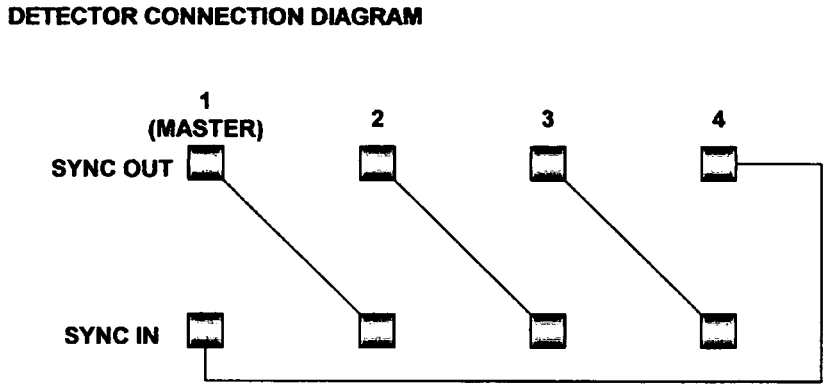
FIG. 2 is a schematic diagram illustrating a vehicle detector system in a series synchronization configuration.

FIG. 2 is a schematic diagram illustrating a vehicle detector system in a series synchronization configuration. As seen in this Fig., the Sync Out signal from the master detector (detector #1 labelled "Master") is coupled to the Synch In signal input of the first slave detector in the series (detector #2). The Synch Out signal from detector #2 is coupled to the Synch In signal input of detector #3 (the next slave detector in the series). The Synch Out signal from detector #3 is coupled to the Synch In signal input of detector #4 (the next and last slave detector in the series). The Synch Out signal from detector #4 is coupled to the Synch In signal input of detector #1 (the master detector).

Figure 3:
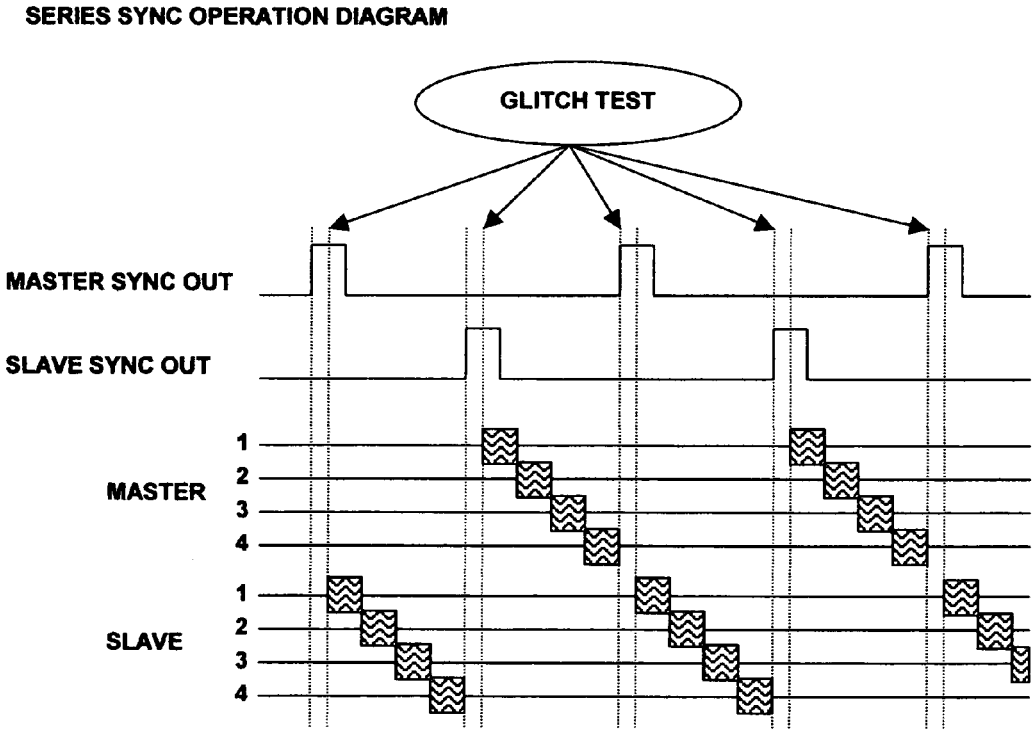
FIG. 3 is a timing diagram of a series synchronization configuration.

In the series synchronization implementation illustrated in FIG. 2, only one channel from all the channels in the detector system is active at any given time. The sampling process begins with master detector #1 sampling all its channels one by one. When finished, the master detector sends a Synch Out pulse to detector #2 which signals detector #2 to begin sampling its channels. When detector #2 has finished sampling all its channels, it sends a Synch Out pulse to detector #3 which signals detector #3 to begin sampling all its channels. When the last detector in the series has finished sampling all its channels, it sends a Synch Out pulse to the master detector, which then starts to sample all its channels. FIG. 3 shows the interrelationship between the timing of the Master Synch Out pulse, the commencement of slave sampling, and the re-commencement of master sampling. For clarity, FIG. 3 is limited to the one MASTER-one SLAVE configuration shown in FIG. 1. The extension to one MASTER-three SLAVES configuration will be obvious to one of ordinary skill in the art.

The following is a summary of the Series Synch Operation as performed by one MASTER and one or more SLAVES.

Master

Set Synch Duration Time to be 350 ms
If Synch In=high; Else Goto (A)
Drive Synch Out low
Wait up to Synch Duration time for Synch In=low
(A)Drive Synch Out high, output 10 ms pulse (tells slave to sample)
Start a Synch Duration Time timer, wait for Synch In=high (tells master to sample)
If the first complete loop has been done then set the Synch Duration Time to the loop time +15 ms.

If it is after the Synch Duration Time has been determined, then check the remaining time against the Synch Duration time, if it is not within + or −15 ms of Synch Duration time, then the synch had failed.
Glitch Pulse Test (verify Synch In=high for 1 ms)
Set Start Sample flag
Drive Synch Out low
Start 15 ms Timer
Wait for Synch In=low
Wait for Sample Done flag
Goto(A)

Slave

Set Synch Duration Time to be 350 ms
Drive Synch Out low
If Synch In=low; Else Goto (C)
(B) Wait up to Synch Duration Time for Synch In=high (tells slave to sample)
(C) If the first complete loop has been done then set the Synch Duration Time to the loop time+15 ms.
If it is after the Synch Duration Time has been determined, th n check the remaining time against the Synch Duration Time, if it is not within + or −15 ms of Synch Duration Time, then the synch had failed.
Glitch Pulse Test (verify Synch In=high for 2 ms)
Set Start Sample flag Drive Synch Out low
Start 15 ms Timer
Wait for Synch In=low
Wait for Sample Done flag
Drive Synch Out high, output 10 ms pulse (tells master to sample)
Goto (B)

Series Synch Failure

If Synch failed, then start a 600 ms timer, then go back to synch and start from the beginning. If the error is corrected within 600 ms, then the error is cancelled. If the error persists after 600 ms, then the error is latched until a power down reset or a reset pin reset. Changing Synch Mode resets failure.

Figure 4:
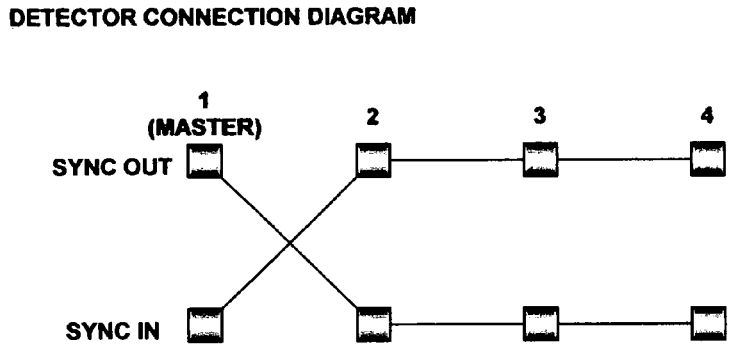
FIG. 4 is a schematic diagram illustrating a vehicle detector system in a parallel synchronization configuration.
Figure 5:
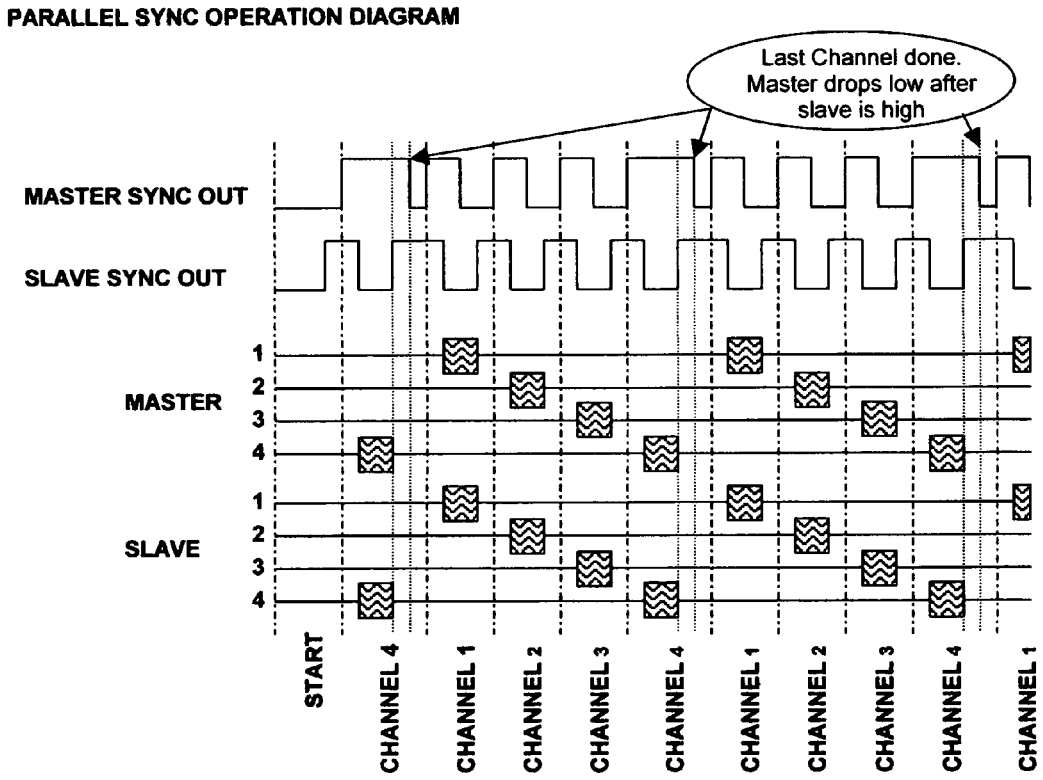
FIG. 5 is a timing diagram of a parallel synchronization configuration.

FIG. 4 is a schematic diagram illustrating a vehicle detector system in a parallel synchronization configuration. As seen in this Fig., the Synch Out signal from detector #1 (the master detector) is connected to the Synch In signal inputs of detectors #2, 3, and 4 (all the slave detectors). The Synch Out signals from each of detectors #2, 3, and 4 (all the slave detectors) are all coupled in parallel to the Synch In signal input of detector #1 (the master detector).

Master

Drive Synch Out low
Delay 20 ms
Verify Synch In=low (A)

1. Start a 20 ms timer, wait for Synch In=high
2. When Synch In=high, Glitch Test for 1 ms
3. Drive Synch Out low for 5 ms
4. Drive Synch Out high, start a 20 ms timer and wait for Synch In to go low
5. If the next sampling channel is the last channel (channel 4), then continue to 6. If the next sampling channel is not the last channel (channel 4), set the Synch Out low after 5 ms.
6. Set Start Sample flag
7. Wait for Sample Done flag
8. If there is a time out from the 20 ms timer above, then go to (C), otherwise, go to (A)

Slave

Drive Synch Out low
Delay 20 ms
Verify Synch In=low (B)

1. Start a 20 ms timer, Drive Synch Out high, and wait for Synch In=high
2. Glitch Test for 1 ms
3. Drive Synch Out low
4. Set Start Sample flag
5. Wait for Sample Done flag
6. When the Sample Done flag is set, if Synch In is low, then go to (B)
7. If Synch In is high, then set the next sampling channel to be the first channel (channel 1)
8. Restart the 20 ms timer, wait for Synch In=low
9. If there is a time out from the 20 ms timer above, then go to (C), otherwise, go to (B)

(C) Parallel Synch Failure

If Synch Failed, then start a 500 ms timer, and go back to synch and start from the beginning. If the error is corrected within 500 ms, then the error is cancelled. If the error persists after 500 ms, then the error is latched until a power down reset or a reset pin reset. Changing Synch Mode resets failure.

Figure 6:
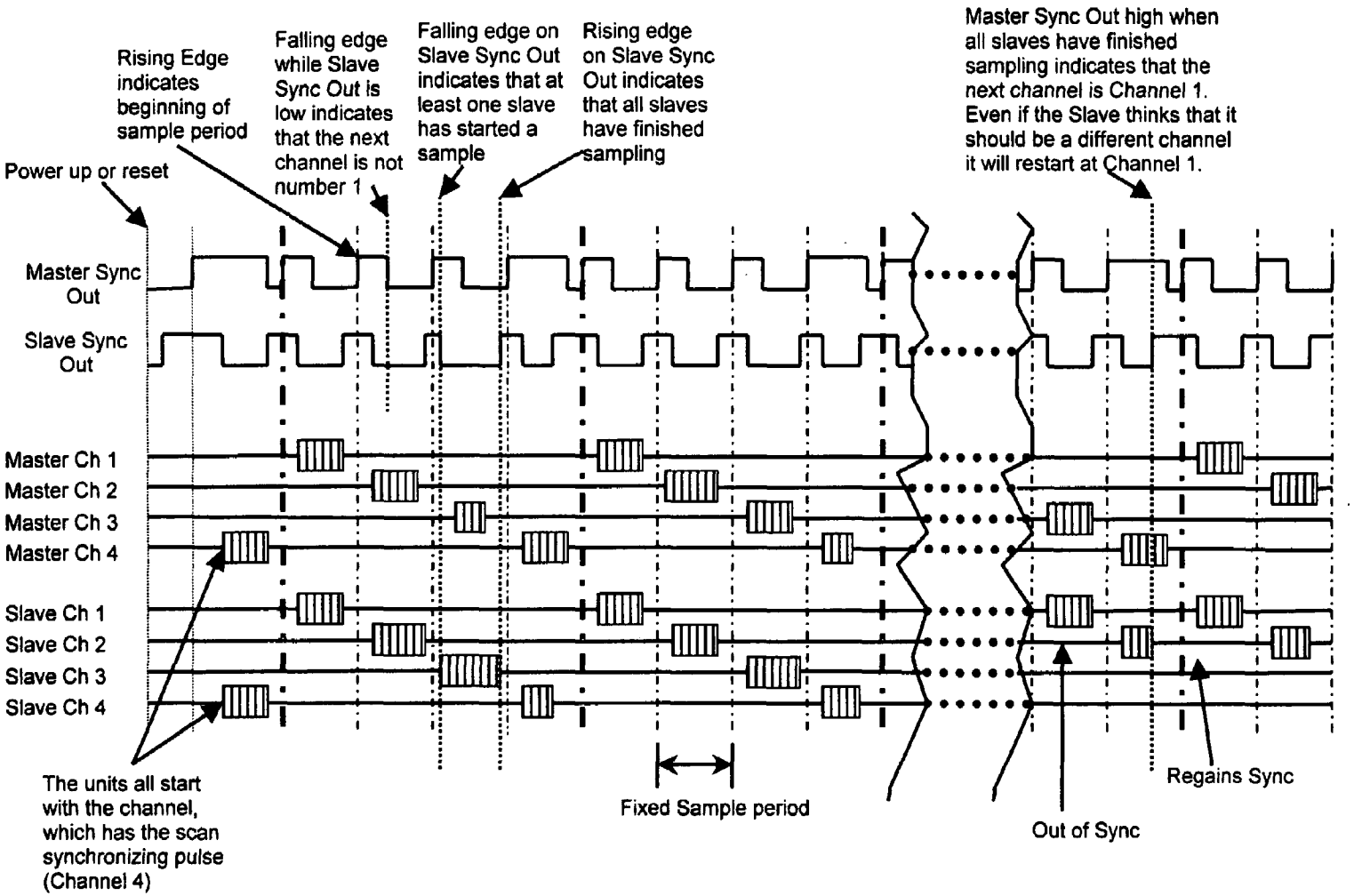
FIG. 6 is a more detailed annotated timing diagram of a parallel synchronization configuration.

FIG. 6 is an expanded timing diagram illustrating parallel mode of operation, with annotations for further describing this mode of operation.

As will now be apparent, the invention enables the synchronous operation of a number of individual vehicle detectors, each capable of multi-channel operation. Synchronous operation can be configured in series or parallel mode. In general, the series configuration is easier to install, since the installer need not be concerned with the relative positions of the many loops involved. There is minimum cross talk with this configuration, since only one channel can be active at any given moment. This configuration has the disadvantage, when compared to the parallel configuration, of having a longer response time than the parallel configuration. The parallel configuration has the advantage over the series configuration of a shorter response time. A disadvantage of the parallel configuration, when compared to the series configuration, is that the loop installation is somewhat position sensitive since each detector in the system can have active channels at the same time. The installer of ordinary skill in the art can decide which of the two possible configurations is most suitable for a given installation.

Although the above provides a full and complete disclosure of the preferred embodiments of the invention, various modifications, alternate constructions and equivalents will occur to those skilled in the art. For example, systems may be configured with different numbers of slave detectors than two or four, as described above. Therefore, the above should not be construed as limiting the invention, which is defined by the appended claims.

What is claimed is:

1. A synchronous vehicle detector system comprising;

at least two vehicle detectors each having at least one vehicle loop to which that detector can be coupled for vehicle sampling purposes, one of said vehicle detectors comprising a master vehicle detector and the remaining ones of said at least two vehicle detectors comprising slave vehicle detectors; and means for synchronizing the operation of said at least two vehicle detectors so that said master vehicle detector can control the commencement of vehicle sampling of said slave vehicle detectors, said synchronizing means including a synch input and a synch output for each of said at least two vehicle detectors, the synch output of said master vehicle detector being coupled to the synch input of said slave vehicle detectors, the synch output of said slave vehicle detectors being coupled to the synch input of said master vehicle detector, said slave vehicle detectors being responsive to the receipt of a synch input signal at said synch input thereof to enable vehicle sampling by said slave vehicle detectors, said master vehicle detector being responsive to the receipt of a synch input signal from at least one of said slave vehicle detectors to enable vehicle sampling by said master vehicle detector.

2. The invention of claim 1 wherein said means for synchronizing comprises circuitry incorporated in said vehicle detectors for specifying one of said at least two vehicle detectors as said master vehicle detector to control the synchronous operation of the remaining ones of said said at least two vehicle detectors.

3. The invention of claim 1 wherein said vehicle detector system is configured for series synchronization.

4. The invention of claim 1 wherein said vehicle detector system is configured for parallel synchronization.

5. A method of controlling the operation of at least two vehicle detectors in a synchronous manner, said method comprising the steps of:

(a) assigning one of said vehicle detectors the role of master detector; and (b) operating the remaining number of vehicle detectors as slave detectors to the master, said step (b) of operating including the steps of supplying a synch signal from the master vehicle detector to the at least one slave vehicle detector, permitting the at least one slave vehicle detector to commence vehicle sampling in response to the receipt of a synch signal, supplying a synch signal from the at least one slave vehicle detector to the master vehicle detector after the at least one slave vehicle detector has finished the vehicle sampling, and permitting the master vehicle detector to commence vehicle sampling in response to the receipt of a synch signal from the at least one slave vehicle detector.

6. The method of claim 5 wherein said step (b) is performed in series synchronization.

7. The method of claim 5 wherein said step (b) is performed in parallel synchronization.

* * * * *